United States Patent [19]

Van Landingham

[11] Patent Number: 4,760,727

[45] Date of Patent: Aug. 2, 1988

[54] ELECTRIC BEND HEAD FOR BENDING TUBES

[75] Inventor: Thomas A. Van Landingham, Wyoming, Mich.

[73] Assignee: McInerney Incorporated, Grand Rapids, Mich.

[21] Appl. No.: 67,370

[22] Filed: Jun. 29, 1987

[51] Int. Cl.[4] ..... B21D 7/04

[52] U.S. Cl. ..... 72/149

[58] Field of Search ..... 72/149, 150, 154, 156, 72/157, 158, 159

[56] References Cited

U.S. PATENT DOCUMENTS

| | | | |
|---|---|---|---|
| 1,848,753 | 3/1932 | Spate et al. | 72/154 |
| 2,583,479 | 1/1952 | Froedge | 72/156 |
| 2,667,202 | 1/1954 | Froedge | 72/156 |
| 3,584,492 | 6/1971 | Dodge et al. | 72/159 X |
| 3,974,676 | 8/1976 | Eaton | 72/307 |
| 4,552,006 | 11/1985 | Yogo | 72/149 |

FOREIGN PATENT DOCUMENTS

| | | | |
|---|---|---|---|
| 376351 | 5/1964 | Switzerland | 72/158 |
| 525895 | 9/1940 | United Kingdom | 72/157 |
| 940916 | 7/1982 | U.S.S.R. | 72/149 |

*Primary Examiner*—E. Michael Combs

*Attorney, Agent, or Firm*—Cullen, Sloman, Cantor, Grauer, Scott & Rutherford

[57] ABSTRACT

An electric bend head for bending tubes includes a frame mounting a gear box housing with a rotatable main shaft extending through the housing. A secondary shaft coaxial of the main shaft is journaled within the housing and projects therefrom. A rotatable worm gear within the housing is coaxially mounted upon the secondary shaft and a worm drive gear is journaled upon the housing and in mesh with the worm gear. A variable speed reversible electric motor upon the frame has a main drive shaft, and a transmission interconnects the drive shaft and the worm drive gear. A secondary drive plate is mounted the secondary shaft and a main drive plate is spaced from the secondary plate and mounted upon the main shaft. A bend die of semicircular shape, having an outwardly opening channel, is axially mounted upon the main plate. A clamp die is slidably mounted upon the main plate and has, upon one side, a laterally opening channel, has a retracted position, and a pipe clamping position engaging the bending die and retaining the tube to bent therebetween. A follower interconnects the plates whereby initial rotation of the secondary plate cams the follower and clamp die in clamping position and successively rotates the bending die through a predetermined arc.

6 Claims, 2 Drawing Sheets

ELECTRIC BEND HEAD FOR BENDING TUBES

FIELD OF THE INVENTION

The present invention relates to a bending device which uses an electric motor as a source of torque instead of the heretofore-used hydraulic-powered devices for accomplishing bending functions. The motor is controlled by a servoed variable speed drive with a position command capability to facilitate bend angle programming.

THE PRIOR ART

Heretofore in bending tubes and the like, various types of hydraulic-powered devices have been employed as a source of torque for accomplishing bending functions with respect to a bend die. With hydraulic-powered devices heretofore employed, it was difficult to preselect the bending angle without additional equipment needed to interrupt the hydraulic-powered device where bending has gone through a predetermined angular arc.

SUMMARY OF THE INVENTION

An important feature of the present invention is to provide an electric bend head which uses an electric motor as a source of torque in lieu of hydraulic-powered devices for accomplishing bending functions. As a further feature, the electric motor is controlled by a servoed variable speed drive with a position command capability to facilitate bend angle programming.

As a further feature, adequate torque/speed requirements are accomplished through a worm drive reduction gearing mechanism driven by the output shaft from an electric motor having a suitable speed control for limiting the arc of rotation of the bend die and the workpiece tube clamped thereon.

Another feature includes, in conjunction with the bending die, a main support shaft journaled upon a gear housing and projected into an electric brake on the underside of a frame whereby the bend die and its supporting main plate are retained against rotation during clamping and unclamping of the pipe with respect to the bend die.

An important feature includes a secondary shaft which is connected to a worm gear within the gear housing driven by a worm drive gear and wherein the worm gear is operatively connected to a secondary drive plate together with a follower assembly which, with a lost motion connection, is adapted to drivingly engage an overlying main plate which supports the bend die.

Another feature includes a clamp die which is slidably mounted upon the main drive plate and wherein a follower slidably mounts the clamp die so it has a retracted position and a clamping position. Initial rotation of the secondary drive plate with respect to the main drive plate mechanically cams the follower and clamp die from the retracted position to registry with the clamp die in a workpiece engaging and retaining position.

As a further feature, upon application of sufficient torque to the secondary drive plate, the follower effects corresponding rotative torque to the main drive plate for rotating the semicircular bending die for wrapping the tube around the bending die to the extent of angular rotation of said bend die under the control of the electric motor.

As a further feature, when the tube is clamped, a wiper die is brought into place in retaining engagement with the tube to be bent, constraining the tube to rectilinear movements. When the clamp pressure becomes great enough to bend the tubing, the follower starts rotation of the main plate. The tubular part captured between the bend die and the clamp die bends to conform to the radius of the bend die due to the buckling action of the wiper die.

These, and other objects and features, will be seen from the following specification and claims in conjunction with the appended drawings.

THE DRAWINGS

It will be understood that the above drawings illustrate a preferred embodiment of the invention, and that other embodiments are contemplated within the scope of the claims hereafter set forth.

DETAILED DESCRIPTION OF AN EMBODIMENT OF THE INVENTION

Figure 1:
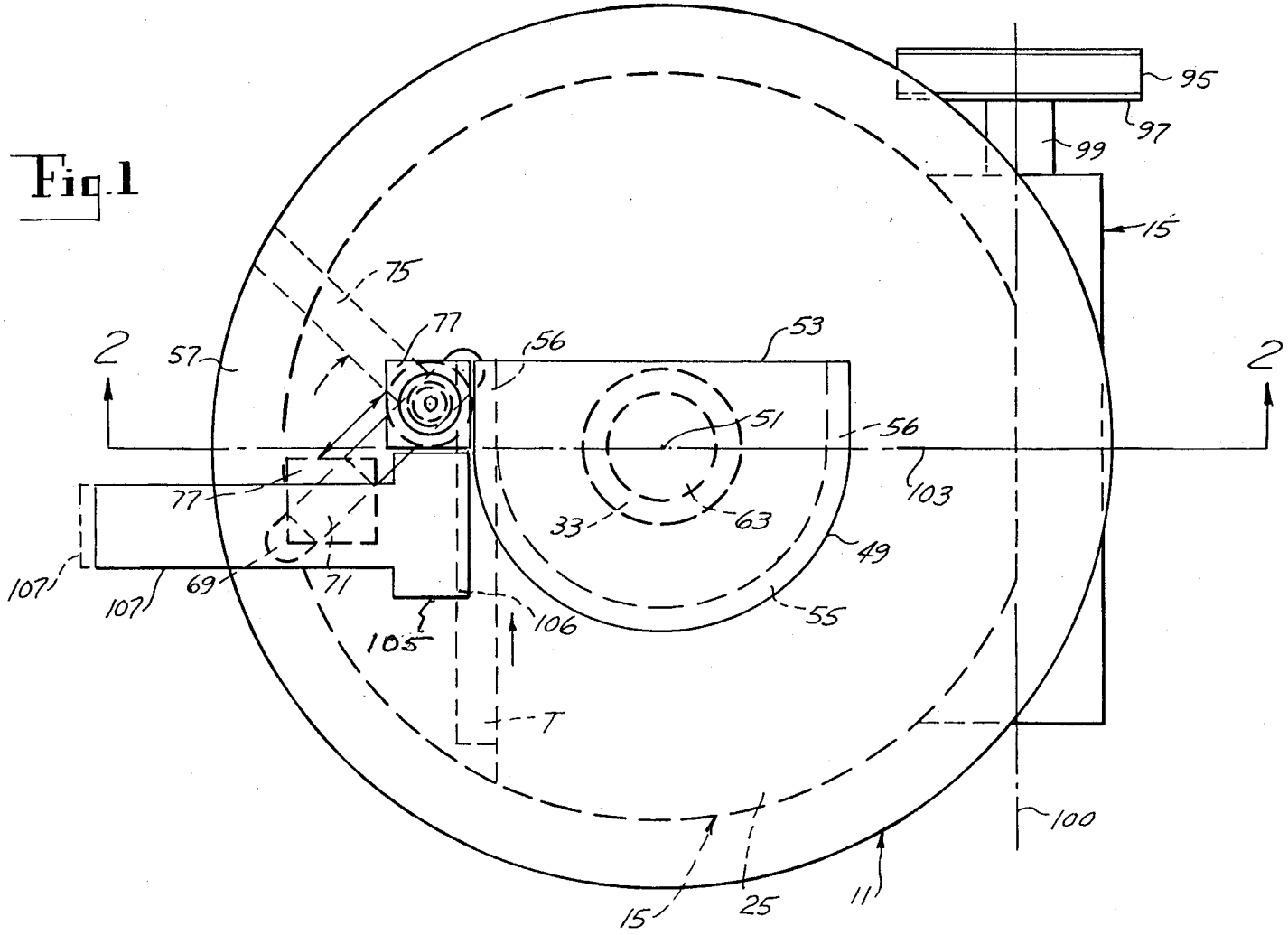
FIG. 1 is a plan view of the present electric bend head for bending tubes.
Figures 2, 3:
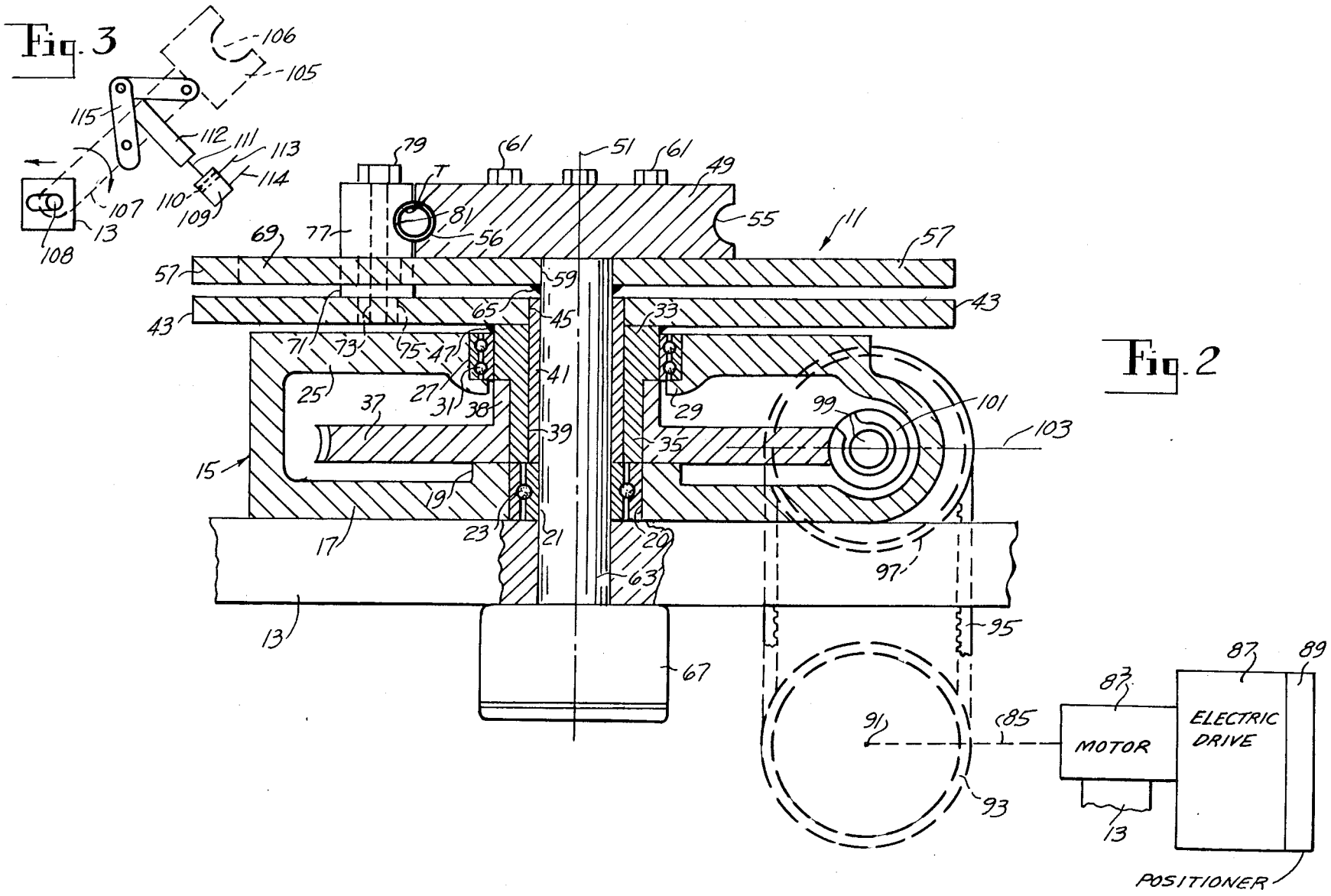
FIG. 2 is a fragmentary vertical section taken in the direction of arrows 2—2 of FIG. 1.
FIG. 3 is a side view of the wiper die when retracted.

Referring to the drawing, the present electric bend head for bending tubes generally designated at 11, FIGS. 1 and 2, is adapted for bending tubular workpiece such as the tube T shown in phantom lines in FIG. 1 of a predetermined diameter. On the machine frame 13, fragmentarily shown, there is positioned and secured gear box housing 15 which includes bottom circular plate17 mounted upon the frame and an overlying circular top plate 25.

Bottom plate 17 includes an inturned annular flange 19 having a bore 20 within which is positioned and retained ball bearing 23. Top plate 25 has an inturned flange 29 defining thereabove a counterbore 27 within which is positioned and retained ball bearing 31.

Secondary shaft 33 of tubular form is arranged upon a first or upright axis 51 and is journaled within ball bearings 31. Shank 35 of reduced diameter is axially mounted upon lower bearing 23 and receives internal annular flange 38 of worm gear 37. Said flange bears against secondary shaft 33, surrounds and is suitably secured to shank 35 as by a key or otherwise. Worm gear 37 is nested and rotatable within gear box housing 15, FIG. 2.

Secondary shaft 33, 35 has an axial bore 39 within which is positioned elongated bushing 41 which extends from bearing 23 through bore 45 in secondary circular drive plate 43. As shown in FIG. 2, said drive plate is coaxial of secondary shaft 33 which rotates upon first axis 51 and is secured to the secondary shaft by welds 47.

Bend die 49 is generally semicircular and has an arc of 180°, for illustration, with a center of rotation which corresponds to the first axis 51 in FIG. 2. Said bend die includes a forwardly extending rectangular extension 53 arranged upon one side of centerline 51.

Formed around bend die 49 is a tubular channel 55 of semicircular cross-section and is of 180° extent. The ends of extension 53 have corresponding outwardly opening channels 56, FIG. 1, of the same cross-sectional shape as channel 55. The radius of bend die 49 is preselected, having the channels 55, 56 adapted to correspond to the diameter of the tube T to be bent using the present apparatus. Bend die 49 may be replaced with a different bend die of greater or less radius. Also, the channel radii will vary to accommodate different radius tubes.

Bend die 49 is centrally mounted upon the circular main drive plate 57 and is secured thereto by fasteners 61. Circular drive plate 57 has a central bore 59 upon axis 51 and receives the upper end of main shaft 63. Said shaft extends through frame 13, bearing 23, bushing 41, and is secured to plate 57 by welds 65, FIG. 2.

There is schematically shown in FIG. 2 an electric brake 67 of a conventional construction which underlies and is secured to frame 13 and receives one end of main shaft 63. The electric brake functions in a conventional manner such that, when energized, it restrains main shaft 63 against rotation and correspondingly retains bend die 49 against rotation.

Angular elongated control slot 69, sometimes referred to as a cam slot, is formed through main plate 57, FIGS. 1 and 2, and is adapted to slidably receive rectangular follower 71. Said follower has a depending circular follower 73 which is slidably positioned within a corresponding slot 75 within secondary plate 43, oriented 90 degrees relative to slot 75 FIG. 1.

Clamp die 77, of square shape in plan, FIG. 1, overlies and is fixedly secured to follower 71 so that it moves between the retracted dash-line position shown in FIG. 1 to the advanced clamp position in registry with bend die 49 and the corresponding bend die extension 53. Clamp die 77 is secured to follower 71 by fastener 79 which extends through the clamping due into and through follower 71 and into follower 73 within slotted portion 75 within secondary drive plate 43.

Upon one side of the clamp die, there is an elongated channel or recess 81 of semicircular shape in cross-section corresponding to the cross-sectional shape of the semicircular groove 55, 56 within bend die 49.

As schematially shown in FIG. 1, when the clamp die 77 has been cammed to the clamp position shown in solid lines, it is in operative engagement with bend die extension 53, FIGS. 1 and 2, and retainingly engages the tube T, fragmentarily shown, which is interposed between and nested within the corresponding channels of the clamp die and the bend die and anchored thereto. The grooves 56, 81 in bend die 49 and clamp die 71 match the diameter of tube T, but neither is deep enough to allow the dies to come in contact. The tube T keeps them separated. This establishes a "locked condition".

Referring to FIG. 2, the reversible electric motor 83 is suitably mounted upon frame 13, as schematically shown, and includes a drive shaft 85 connected to a variable speed drive assembly 87 having a servoed control at 89 which is programmable for position command for bend angle programming in conjunction with the controlled rotation of bend die 49 through a predetermined arc of the bending of tube T.

Drive shaft 85 mounts a drive sheave 93 journaled at 91 engaging and positioned within continuous drive belt 95, fragmentarily shown, and which receives and is in driving engagement with driven sheave 97 on the end of worm drive shaft 95, FIGS. 1 and 2.

Shaft 99 is journalled within a portion of gear box housing 15, FIG. 1, within suitable bearings upon the interior thereof and mounts a worm drive gear 101, FIG. 2, which extends along a second axis 100 corresponding to the longitudinal axis of worm drive shaft 99, which is laterally spaced from and extends at right angles to first axis 51. Shaft 99 has a longitudinal axis which extends at right angles to the transverse axis 103, FIG. 2, which extends at right angles to axis 51.

Wiper die 105, schematically shown in FIG. 1, is movably positioned upon frame 13 so that during bending, it will retainingly engage tube T to constrain said tube to rectilinear movements along its longitudinal axis during successive rotation of bend die 49 over a predetermined angle which is programmed for a particular bending of said tube. Said wiper die is square ended and is grooved at 106 along one side to match the tube T diameter and cooperatively engage said tube. The length of the wiper die is at least two times the diameter of the tube and extends along the length of the tube. During a bending operation the wiper die is adjacent clamp die 77 to cause the bend to start at datum line 2—2 of FIG. 1. As shown in FIG. 1 during bending, wiper die 105 is horizontal and in engagement with tube T. Wiper die includes arm 107 at one end pivotally mounted at 108, FIG. 3, upon a slotted portion of frame 13 and adapted for a limited retracting movement. At completion of a bend, cylinder 109 is activated through one of its feed lines 113 and 114 to advance its piston 110 and piston rod 111. Said piston rod is connected to linkage 112, 115 for initially retracting arm 107 horizontally, FIG. 1 to a position sufficient that the lower lip of the tube groove is clear of the tube. At this point, the linkage is restricted and the cylinder action forces the wiper arm 107 to rotate on axis 108. When the wiper 107 has been retracted and pivoted a clearance has been created to withdraw clamp die 77.

The electric motor 83 and its output drive shaft 85 are connected to the variable speed drive 87 under a servoed control 89 to provide a variable speed drive and with a position command capability to thus facilitate bend angle programming for a particular angle of bending for a particular tube T. Adequate torque/speed requirements accomplished through a worm drive reduction gearing mechanism at 101, 37.

Bend die 49, 53 is mounted upon circular main plate 57 coaxially thereof and is connected to main shaft 63. This shaft extends through the gear housing and into electrical brake 67. The brake is used during clamping and unclamping only. Main shaft 63 is supported by bushing 41 which is mounted inside secondary shaft 33, 35. The secondary shaft is connected to worm gear 37 and secondary drive plate 43. Follower 71 rides in the angular cam slot 69 which is driven by secondary plate 43. The clamp die is connected to follower 71. The main shaft and the worm gear are not coupled together.

Bending is achieved when the worm drive gear 101 is rotated by electric motor 83. This, in turn, starts rotation of the worm gear 37 and secondary plate 43. With the brake 67 energized and plate 57 held in position, clamp die 77 starts its inward motion along cam slot 69. Upon bottoming out against the tube T, FIG. 1, clamping is achieved with clamp die 77 in registry with bend die extension 53 and engaging tube T.

The wiper die 105, schematically shown, is then brought into place on retraction of piston 110 and brake 67 de-energized. When the clamp pressure becomes great enough to bend the tubing, follower 71 starts rotation of main plate 57 and corresponding rotation of bend die 49 axially connected thereto. The tube T, captured between bend die 49 and clamp 77, bends to conform to the radius of the bend die due to the bucking action of the wiper die. As the assembly rotates, the wiper die 105 is held in a fixed position, FIG. 1, causes the tube to wrap around the bend die creating the bend.

When the programmed bend angle is reached, the motor is stopped and the wiper die is retracted, FIG. 3. Brake 65 is again energized, and rotation of motor 83 is reversed. The clamp die 77 releases and backs off towards its retracted dash line position, FIG. 2. Clamp die 77, when it reaches the end of slot 69, bottoms out the brake is again released and said motor starts reverse rotation of main drive plate 57, and bend die 49 returns to the start position shown in FIG. 1. The bent tube is removed and another one inserted and the process is repeated.

Having described my invention, reference should now be had to the following claims.

I claim:

1. In an electric bend head for bending tubes:

a frame;

a gear box housing mounted upon said frame;

a main shaft rotatable upon a first axis extending through said frame and journaled through and upon said housing and outwardly thereof;

a secondary shaft coaxial of said main shaft and journaled within and upon said housing and projecting therefrom;

a rotatable worm gear within said housing coaxially mounted upon and secured to said secondary shaft;

a worm drive gear journaled within and upon said housing upon a second axis laterally spaced from and at right angles to said first axis and in mesh with said worm gear;

a variable speed reversible electric motor upon said frame having a drive shaft;

transmission means between and interconnecting said drive shaft and worm drive gear;

a secondary circular drive plate outwardly of said housing coaxial to, mounted upon and secured to said secondary shaft and rotatable therewith;

a circular main drive pate spaced from and overlying said secondary plate coaxial to, mounted upon and secured to said main shaft;

a bend die of semicircular shape having an outwardly opening channel of semicircular cross-section of a radius corresponding to the radius of the tube to be bent, adapted to receive a portion of said tube, coaxial of, mounted upon and secured to said main plate;

a clamp die slidably mounted upon said main drive plate having upon one side a laterally opening channel of corresponding cross-sectional shape having a retracted position and a pipe clamping position engaging said bend die and retainingly engaging said tube therebetween;

a follower between and interconnecting said plates whereby initial power rotation of said secondary plate cams said follower and clamp die to a clamping position, and successively rotates said bending die over a predetermined arc with the radius of the bend in said tube corresponding to the radius of said bend die; and a servo-controlled variable speed drive connected to said motor drive shaft, having a position command capability to facilitate present bend angle programming.

2. In the electric bend head of claim 1, said housing having a top plate and a bottom plate, with the bottom plate mounted upon said frame;

the mounting of said main shaft and secondary shaft including coaxial bearings mounted and supported within said plates respectively; and a bushing interposed between said shafts and extending through said secondary drive plate.

3. In the electric bend head of claim 1, an electrically energized brake upon the undersurface of said frame coaxial to and receiving said main shaft, energization of said brake retaining said main shaft against rotation during clamping and unclamping of said tube.

4. In the electric bend head of claim 1, the mounting of said follower including an elongated slot through said main drive plate extending inwardly at an acute angle toward said bend die and displaced laterally thereof;

said follower being slidably mounted within said slot;

said clamp die being secured to said follower, and said follower being movably connected to said secondary die plate.

5. In the electric bend head of claim 1, said transmission means including a worm drive shaft journaled within said gear box housing upon said second axis and projecting therefrom and mounting said worm drive gear;

a first drive sheave upon one end of said worm drive shaft;

a second sheave upon said motor drive shaft; and a continuous drive belt interconnecting said sheaves.

6. In the electric bend head of claim 1, a movable wiper die mounted upon said frame and pivotal into and against said tube constraining end portions thereof to rectilinear movements during rotation of said bend die, the pivotal mounting of said wiper die including an arm mounting the wiper die, at one end pivotally mounted upon said frame;

a cylinder assembly upon said frame including a reciprocal piston rod;

and a linkage interconnecting said piston rod and said arm.

* * * * *